US005282580A

United States Patent [19]

Kent

[11] Patent Number: 5,282,580

[45] Date of Patent: Feb. 1, 1994

[54] METHOD AND APPARATUS FOR WINDING RING-SHAPED ARTICLES

[76] Inventor: Bryan Kent, P.O. Box 444, Sisters, Oreg. 97759

[21] Appl. No.: 764,136

[22] Filed: Sep. 20, 1991

[51] Int. Cl.[5] ..... H01F 41/06

[52] U.S. Cl. ..... 242/4 R; 29/605

[58] Field of Search ..... 242/4 R; 29/605

[56] References Cited

U.S. PATENT DOCUMENTS

| | | | |
|---|---|---|---|
| 1,946,870 | 4/1932 | Moon | 153/66 |
| 2,160,588 | 5/1939 | Granfield | 175/356 |
| 2,221,687 | 11/1940 | Evans | 242/4 |
| 2,263,972 | 11/1941 | Leoser | 242/4 |
| 2,810,530 | 10/1957 | Marsters | 242/4 |
| 2,905,399 | 9/1959 | Baker | 242/4 |
| 2,974,890 | 3/1961 | Davis | 242/4 |
| 3,000,580 | 9/1961 | Matovich, Jr. | 252/4 |
| 3,132,816 | 5/1964 | Oshima | 242/4 |
| 3,191,878 | 6/1965 | Kitano | 242/4 |
| 3,307,991 | 3/1967 | Fahrbach | 156/172 |
| 3,333,779 | 8/1967 | Rey | 242/4 |
| 3,732,901 | 5/1973 | Kent et al. | 140/92.1 |
| 3,985,310 | 10/1976 | Kent et al. | 242/4 R |
| 4,288,041 | 9/1981 | Marzec et al. | 242/4 R |
| 4,548,365 | 10/1985 | Marzec et al. | 242/4 R |
| 4,768,726 | 9/1988 | Fahrbach | 242/4 R |
| 4,771,956 | 9/1988 | Sato et al. | 242/4 R |
| 4,771,957 | 9/1988 | Schlake et al. | 242/4 B |
| 4,815,672 | 3/1989 | Kaiser et al. | 242/4 R |
| 4,872,618 | 10/1989 | Sato et al. | 242/4 R |

FOREIGN PATENT DOCUMENTS

| | | |
|---|---|---|
| 1439180 | 9/1962 | Fed. Rep. of Germany . |
| 1939873 | 8/1969 | Fed. Rep. of Germany . |
| 1764706 | 10/1971 | Fed. Rep. of Germany . |
| 1151751 | 2/1958 | France . |
| 1288816 | 12/1962 | France . |
| 1572774 | 6/1969 | France . |

OTHER PUBLICATIONS

IBM Technical Disclosure Bulletin, "Core Winding Technique," by J. T. Gulliksen, 8:450 (Aug. 1965).

*Primary Examiner*—Katherine Matecki

*Attorney, Agent, or Firm*—Klarquist, Sparkman, Campbell, Leigh & Whinston

[57] ABSTRACT

An improved method and apparatus for winding wire onto toroidal cores in which the wire is fed into a circular channel to form a coil that passes through the core repeatedly. The wire is fed to the apparatus by a cylindrical capstan for creating tension to straighten the wire. The wire is circulated in the channel by pairs of synchronously driven rollers, with one roller pair gripping the wire more loosely to permit slippage. The channel has a narrowed width adjacent to the rollers to control wire deflection. A movable feed track exit allows smooth feeding of wire into the channel, while permitting increased capacity by sliding the exit inward of the growing coil. A variable transmission adjusts the rate at which the wire is fed into the channel relative to the rate at which it circulates. A split block wire cutter is adjustable to compensate for cutter wear.

31 Claims, 4 Drawing Sheets

METHOD AND APPARATUS FOR WINDING RING-SHAPED ARTICLES

TECHNICAL FIELD

This invention relates to a method and apparatus for winding successive turns of wire of one or more continuous strands of material on a selected work piece, and more particularly to methods and apparatus for winding wire strands onto ring-shaped articles where a large number of turns are required.

BACKGROUND OF THE ART

The method and apparatus disclosed herein are essentially an improvement to the method and apparatus for winding ring-shaped articles disclosed in U.S. Pat. Nos. 3,732,901 and 3,985,310 to Kent, et al, which are incorporated herein by reference.

These patents disclose a method and an apparatus for winding wire strands onto toroidal cores. The apparatus includes a feed mechanism that draws a length of wire from a source spool and feeds it through a feed tube into a radially inwardly facing circular channel. Two pairs of compliant circulating rollers are positioned on opposite sides of the channel to grip the wire and advance it to form a first loop. After the first loop is formed, the leading end of the wire continues to hug the channel's radial boundary as subsequent loops are accumulated inside the first loop during wire feeding.

In the Kent apparatus, a gap is provided in the radial boundary of the channel for receiving a toroidal core, with the core's central aperture aligned with the gap so that the circulating wire passes through the aperture. The upper and lower boundaries of the channel are closely spaced to maintain the loops in a single flat concentric layer as the loops accumulate and are circulated. When sufficient wire has been fed, the feeding is stopped, but the circulation of the loops continues, tightly winding a turn of wire onto the core for each complete circulation of the loops in the channel. Two or more wires can be wound onto a core at the same time with the prior patented Kent apparatus.

Although effective, the Kent apparatus has limited reliability when pushed beyond its useful capacity. It is a complex machine of small scale for manufacturing miniature electronic components; it must operate at a high speed to provide cost-effective manufacturing; the fine wire used is highly susceptible to jamming and buckling, which disable the machine until a skilled technician can correct the problem. These reliability problems prevent the existing machine from being used for manufacturing cores having a large number of wire turns. The existing machine has a circulating channel diameter of 2½ inches, with a capacity of three feet of wire. When greater lengths are loaded, the wire typically jams in the circulating chamber, which can only reliably contain about five loops of wire. This prevents the prior apparatus from being used to manufacture the many wire wound core products of larger size that are currently manufactured by other methods.

An analysis of this problem has revealed that these functional limitations of the prior art apparatus arise from a number of different structural limitations:

A first limitation of the prior art apparatus is that slightly damaged or dented wire may cause a jam in the machine. If a dent occurs in the leading portion of the wire, it is particularly likely to snag or catch in the machine to cause a jam. The prior art feeding mechanism uses a frictional driven roller to draw the wire from a source spool. The driven roller does not provide sufficient tension to draw the wire through a conventional wire straightener to eliminate kinks. The lack of a wire straightener also prevents the use of wire source spools having a smaller diameter than the circulating channel, because the natural curvature of the wire would cause the leading end of the wire to bend inward from the radial boundary of the channel rather than to hug the wall, as is required for successful operation of the machine.

A second limitation of the prior art apparatus is that each circulating roller pair consists of a driven roller and an idler. This results in an imbalanced driving force acting on the wire, which permits inconsistent and unpredictable slippage between the rollers and the wire. Consequently, the wire loops tend to be deflected out of a flat circular path, causing jamming.

A third limitation of the prior art apparatus is that the circulated wire loops are not advanced at precisely the same rate by the opposite pairs of circulating rollers. This can cause the wire to buckle or bunch between the rollers on one side of the channel and to be pulled excessively tight on the other side of the channel. Furthermore, even if the opposite pairs are turned at precisely the same rate, the conical rubber rollers have slightly unpredictable properties which cause errors to accumulate, especially as the number of wire loops in the channel increases.

A fourth limitation of the prior art apparatus is found in a portion of the circulating channel adjacent to the circulating rollers. The upper and lower boundaries of the channel are spaced apart by a width sufficient to permit the wire loops to circulate without excessive resistance. However, this width can be too wide to restrict unwanted deflection of the wire at the circulating rollers. As the leading end of the wire exits a circulating roller pair, there is a tendency for the adjacent loops to attempt to ride over one another, causing the wire to jam. This is increasingly a problem as loops accumulate, and particularly when the leading end of the wire passes through the circulating roller and must push the adjacent inner loops inwardly. Narrowing the channel width to solve this problem only creates a friction problem that impairs circulation of the wire loops.

A fifth limitation of the prior art apparatus is that the feed tube exit is fixed at a position adjacent to the circulating channel radial boundary, which prevents a large number of wire loops from being accumulated in the chamber. The position is a compromise between larger capacity and reliable entry of the wire. The feed tube exit must be positioned sufficiently close to the channel boundary to permit the wire smoothly to contact the radial boundary in a nearly tangential relationship to avoid entry jams. However, this prevents the width of the accumulated bundle of wire loops from exceeding the distance between the tube exit and the channel radial boundary, because the tube exit must remain inward of the innermost loop for feeding to continue.

A sixth limitation of the prior art apparatus is that the wire cutter, which cuts the wire after each core is wound, requires frequent and expensive replacement. The cutter is a cylindrical shear that is sized to fit closely within a cylindrical cutter block bore. As the cutter wears, the fit loosens. Consequently, a dull cutter creates a burr on the leading end of the wire segment instead of cutting it cleanly. Such a burr is likely to catch on a surface of the channel and cause a wire jam. As this problem develops, the cutter must be replaced.

SUMMARY OF THE INVENTION

The primary object of the invention is to provide an improved core winding apparatus and method that operates reliably without jamming, and which has the capacity to wind substantial lengths of wire on ring shaped cores. The preferred embodiment of the invention includes several features which act independently and cooperatively to achieve the above primary object.

The invention may include a cylindrical capstan for drawing wire at a high tension from a source of wire and for introducing the wire to a feed roller pair at a reduced wire tension.

The invention may further include means for driving all the circulating rollers at a synchronous rate.

The invention may also include the feature of closely compressing or spacing one circulating roller pair by a different amount from the other pair, such that the rotation rate of the wire loops will be controlled by the more closely spaced circulating roller pair, with the other pair permitting relative slippage.

The invention may further include a relatively narrow channel width immediately adjacent to the circulating roller pairs to maintain the wire loops in a flat coil, with the rest of the channel remaining at full width to permit unimpeded circulation.

The invention may also include a feed track exit that is radially moveable with respect to the channel. This permits the leading end of the wire to smoothly enter the channel near the boundary, whereafter the exit moves inward to permit a large number of loops to be accumulated in the channel.

The invention further includes an adjustable wire cutter block that is split to permit its bore to be narrowed as the cutter wears, thereby providing clean cuts over an extended product life, without requiring replacement.

The foregoing and additional features and advantages of the present invention will be more readily apparent from the following detailed description which proceeds with reference to the accompanying drawings.

DETAILED DESCRIPTION OF PREFERRED EMBODIMENT

Figure 1:
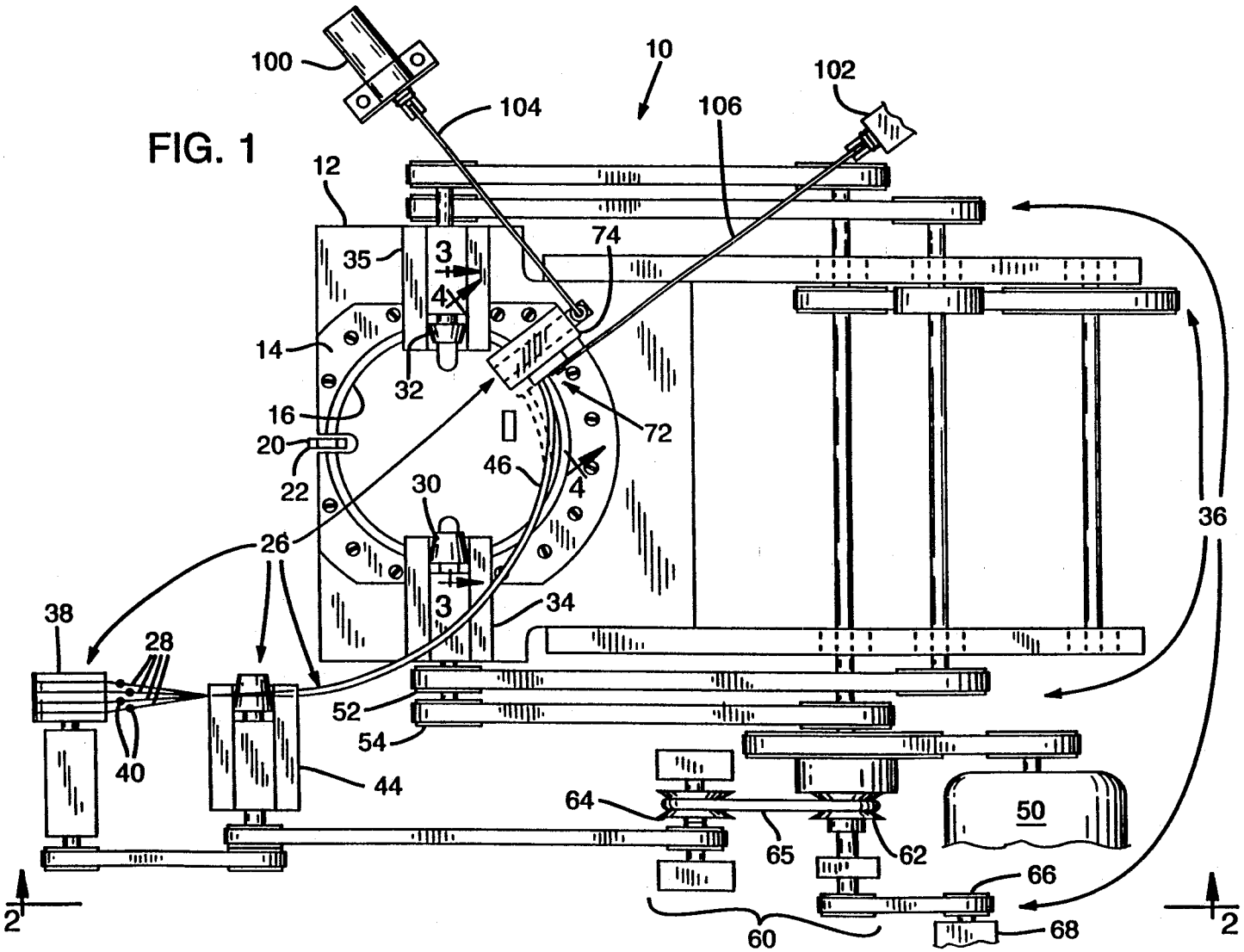
FIG. 1 is a plan view of an apparatus according to the present invention.

FIG. 1 shows an overall view of a core winding mechanism 10. The mechanism includes a base 12 with a circular channel assembly 14 attached to the base and defining a circular, inwardly-open, U-shaped channel 16. A toroidal core 20 is aligned in a core gap 22 defined by the channel assembly 14. A wire supply system 26 is arranged to draw wire 28 from a spool (not shown) and feed it into the channel 16. The wire 28 is circulated within the channel 16 until a desired number of loops are accumulated in a flat, single-layer coil, passing through the core 20.

A first circulating roller pair 30 and a second circulating roller pair 32 are aligned with the channel 16 to grip the accumulated coil of wire 28 within the channel and to circulate it about the channel. The first and second circulating roller pairs 30, 32 are journaled for rotation within circulating roller blocks 34, 35 mounted to the base 12. A drive system 36 is operably connected to mechanically drive the circulating roller pairs 30, 32 and the wire supply system 26 through a sheave and belt mechanism.

As further shown in FIG. 1, the wire passes over a rotatable cylindrical capstan 38 powered by the drive system 36. Each wire 28 may be wrapped around the capstan for additional turns to provide additional wire driving force to overcome the tensional resistance of the wire 28 being pulled off a spool (not shown) and being pulled through a conventional wire straightening device (not shown). Each wire passes through a separate wire brake 40, which is arranged to selectively clamp the wire 28, halting its feeding. Thus, when more than one wire strand is being fed, the wire strands may be fed selectively, as in the example shown in FIG. 1. Because the brakes 40 are positioned downstream of the capstan 38, a clamped wire will slacken around the capstan, permitting the capstan to rotate without damaging or overfeeding the wire. A slight tension on the wire downstream of the capstan is necessary to utilize the tension-amplifying effect of the capstan.

The wire or bundle of wires 28 then passes between a pair of cylindrical or frustoconical feed rollers 42 formed of an elastomeric material such as urethane rubber. The feed rollers 42 are rotatably mounted in a feed roller assembly 44 and, along with the capstan 38, are operably connected to be driven by the drive system 36. The wire 28 exits the feed rollers into a wire track 46 defining a plurality of wire passages (not shown), each passage suitable for containing an individual strand of wire. Alternatively, the track 46 may define a single large passage sized to contain multiple wire strands.

Figure 2:
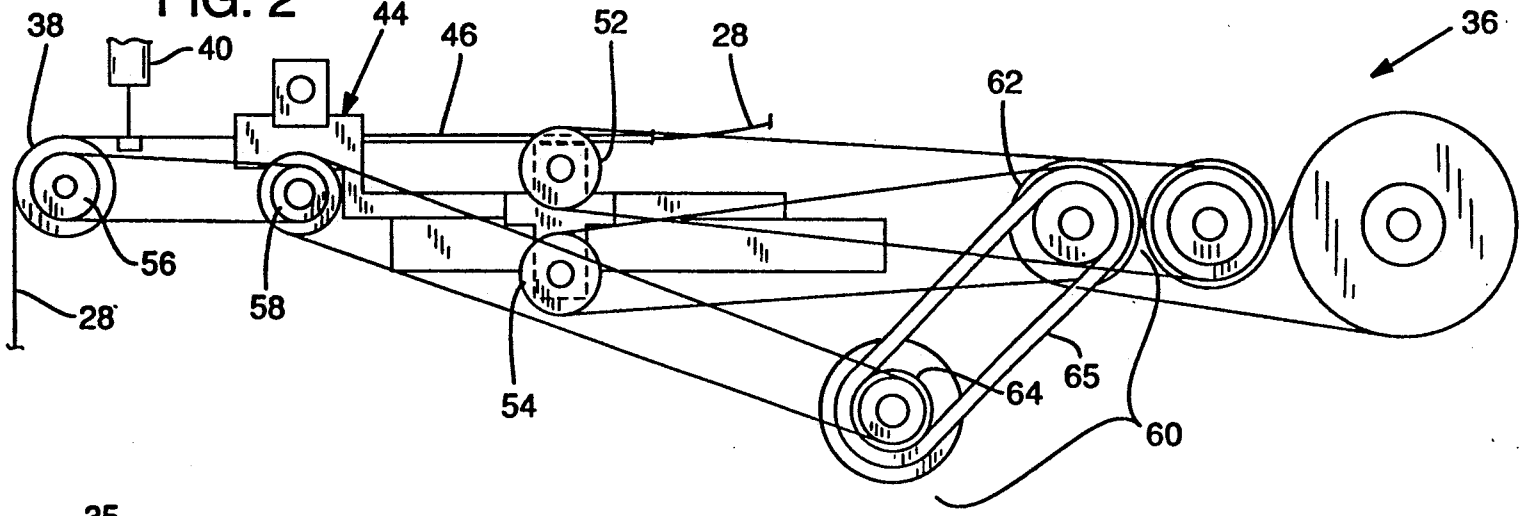
FIG. 2 is a side view of the apparatus of FIG. 1.

FIG. 2 shows a simplified side view of the drive system 36, showing the wire 28 passing over the capstan 38, through the wire brake 40, into the feed roller mechanism 44, and through the wire track 46. A pair of upper and lower circulating roller drive wheels 52, 54 are each mounted to one roller of the second circulating roller pair 32. Each drive wheel 52, 54 is separately and synchronously driven by the drive system 36. The first circulating roller pair 30 is similarly driven. As a result, the wire passing through either circulating roller pair is given a balanced and symmetrical driving force by the circulating rollers, with the upper and lower rollers contributing equally to the circulation of the wire.

As further shown in FIG. 2, the capstan 38 is driven by a capstan drive wheel 56, and the feed roller assembly 44 is driven by a feed roller drive wheel 58. These drive wheels 56 and 58 are rotationally interlinked by a belt, and are rotationally connected to the portion of the drive system operating the circulating rollers by a variable ratio transmission 60. The transmission 60 permits the rate of rotation of the feed rollers to vary with respect to the circulating roller rate.

The variable transmission 60 is a conventional split-sheave variety, the effective radius of a drive wheel 62 and a driven wheel 64 being adjustable to shift the position of a drive belt 65 connected between the wheels. A transmission controller 66 uses a stepper motor 68 or other suitable device for adjusting the gap of the drive wheel to change its effective radius. An increased gap permits the drive belt 65 to engage the drive wheel 62 at a smaller radius, resulting in an increase in the rotation rates of the capstan 38 and feed rollers 42. The driven wheel 64 is spring loaded to compress together its sides to take up slack in the drive belt 65. The controller 66 may be preprogrammed to provide the proper transmission drive ratios throughout the winding cycles, or may be adjusted in real time in response to feedback, such as may be provided by wire position and tension sensors (not shown).

The variable feed ratio is necessary to reduce the feed rate of the feed rollers 42 as the wire 28 accumulates in a coil in the channel 16. Because each successive loop is positioned inwardly of the previously fed loops in the channel, it has a smaller radius and circumference than the preceding loops. Therefore, although the coil rotation rate produced by a constant rotation of the circulating rollers 30, 32 may be unchanged, the feed rollers need to feed successively less wire for each coil rotation.

Figure 3:
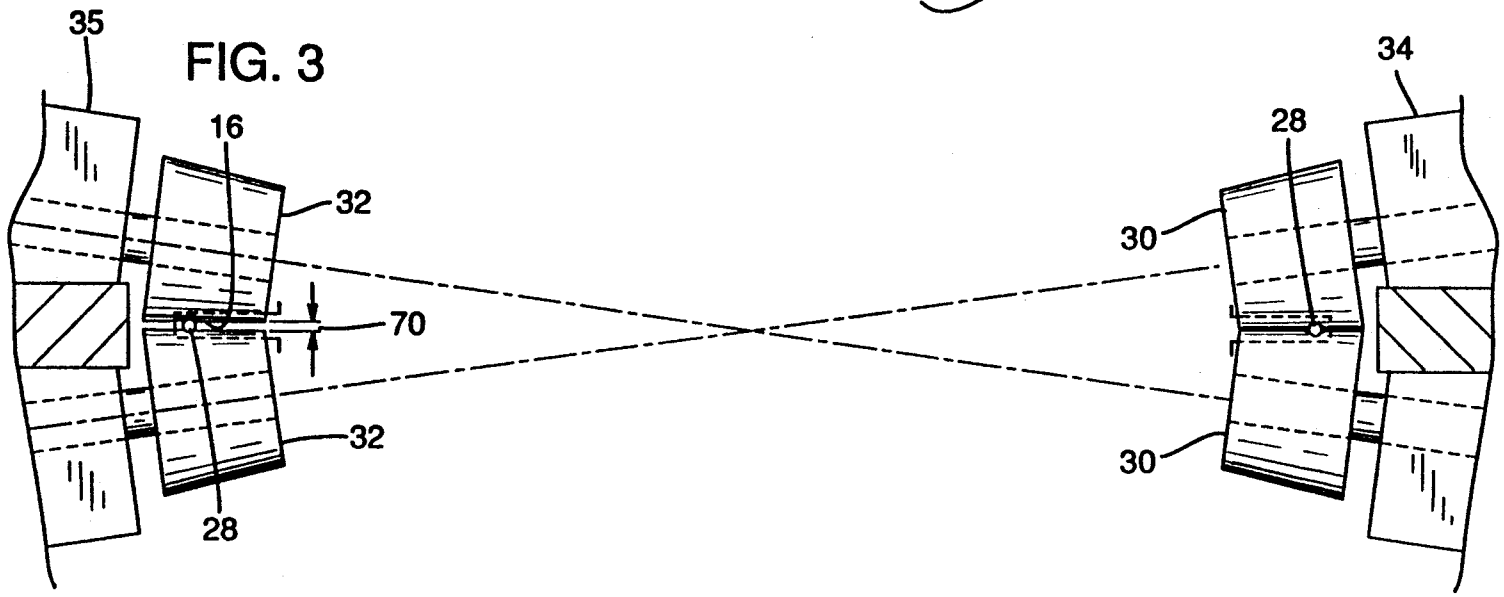
FIG. 3 is a sectional side view of the circulating rollers of the apparatus of FIG. 1 taken along line 3—3 of FIG. 1.

FIG. 3 shows how the opposite pairs of circulating rollers 30, 32 grip the wire 28 with different forces. In the preferred embodiment illustrated, there is no gap between the rollers of the first circulating roller pair 30. Consequently, the wire 28 distorts the rollers, which grip it with a substantial first wire gripping force. The second circulating roller pair 32 is spaced apart by a gap 70 that is slightly less than the diameter of the wire 28, so that the rollers 32 grip the wire with a second wire gripping force less than the first wire gripping force. Thus, the wire may slip slightly as necessary between the second pair of circulating rollers 32 to accommodate small synchronization and rotation errors between the first circulating roller pair 30 and second circulating roller pair 32. This prevents excess tension or bunching of the wire 28. Alternatively, the advantages of a wire gripping force differential may be achieved by having both sets of circulating rollers spaced apart, but by different amounts. This provides a narrow gap and a wider gap, both gaps being less than one wire diameter. In another alternative embodiment, both sets of circulating rollers are in contact, with one set biased together by a first amount, and the other set biased together by a lesser or no amount. It is also preferable that the first circulating roller pair 30 be the tighter gripping pair because it is immediately downstream of the core gap 22 and therefore responsible for creating the tension necessary to wrap the wire tightly onto the core 20.

Figure 4:
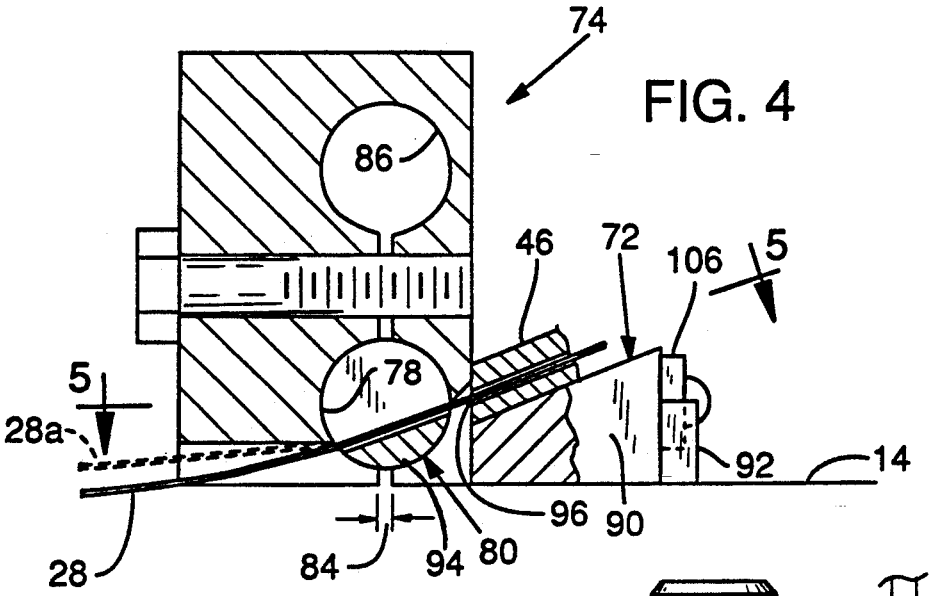
FIG. 4 is an enlarged sectional side view of the cutter block and feed track exit of the apparatus of FIG. 1 taken along line 4—4 of FIG. 1.
Figure 5:
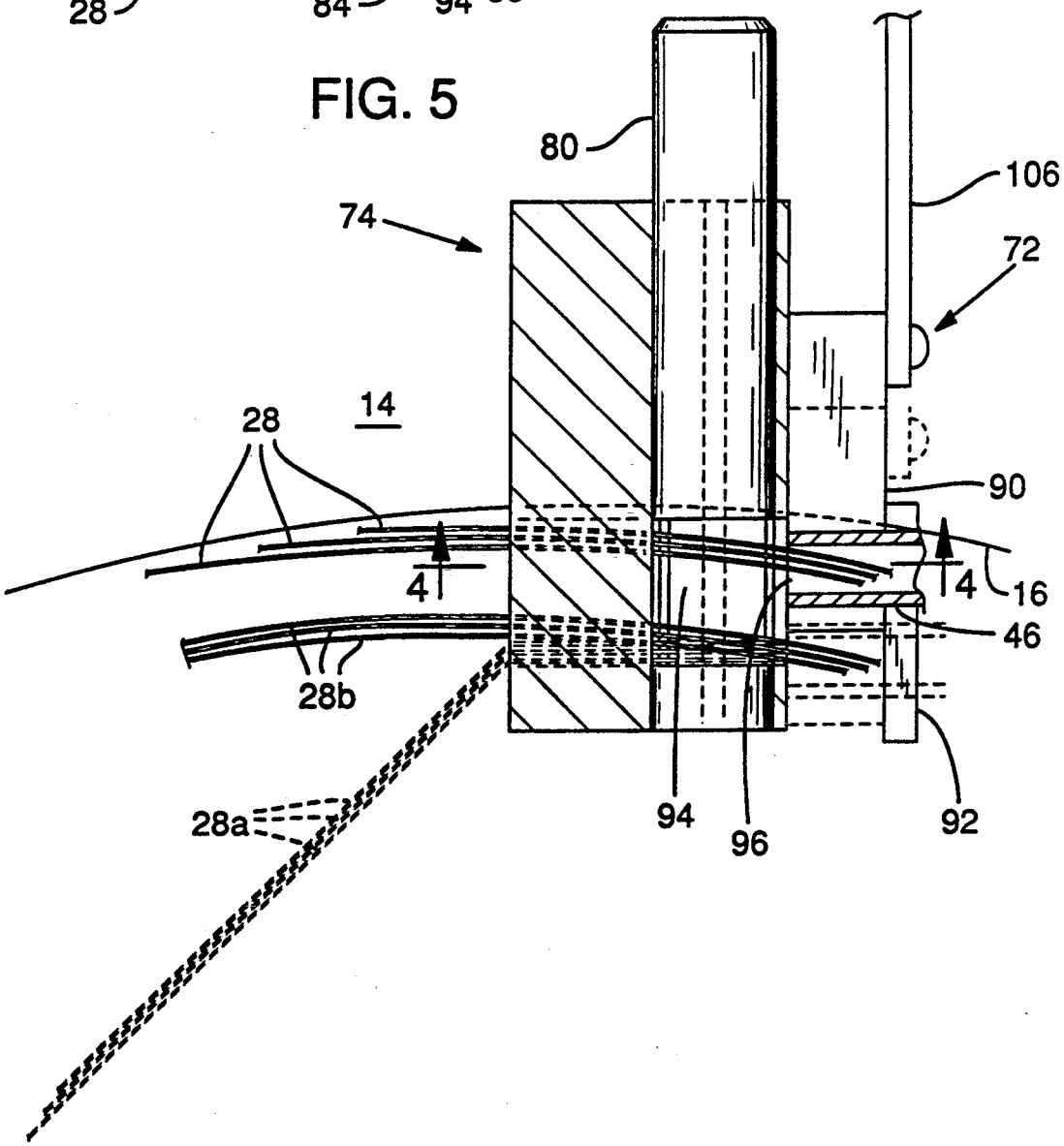
FIG. 5 is an enlarged sectional plan view of the cutter block and feed track exit of the apparatus of FIG. 1 taken along line 5—5 of FIG. 4.

As shown in FIGS. 4 and 5, the wire supply system 26 includes an exit port assembly 72 and a cutter block assembly 74. As shown in FIG. 4, the cutter block assembly 74 includes a cutter block 76 attached to the channel assembly 14. The cutter block 76 defines a primary cylindrical bore 78 sized to closely receive a cylindrical cutter 80. The cylindrical bore 78 and cutter 80 are oriented horizontally and radially with respect to the circular channel 16. A second horizontal bore 86 is spaced parallel to and directly above the primary bore 78. The cutter block 76 further defines a vertical gap 84 extending downward from the second bore 86, through the primary bore 78, and clear through the bottom of the block along its entire length. A screw 88 or suitable fastener penetrates the cutter block 76 perpendicularly to the gap 84 in the region between the bores 78, 86 so that the gap may be adjustably opened and closed. Typically, as the cutter 80 wears, the screw is tightened to narrow the gap 84 and to reduce the horizontal diameter of the bore 78. This permits the cutter to be resharpened and reused over an extended life before replacement is necessary.

The exit port assembly 72 is positioned adjacent to the cutter block assembly 74 so that it may slide freely in a line parallel to the axis of the bore 78. The exit port assembly 72 includes an exit port block 90, which provides a sliding base for the exit end of the wire track 46. The wire track 46 is attached to an upper side of the block 90. The block 90 rests on the channel assembly 14, and is captured between the cutter block assembly 74 and a guide block 92 attached to the channel assembly 14 parallel to the cutter block assembly 74.

As shown in FIG. 5, the cylindrical cutter 80 defines a cutting region 94 along a portion of the cutter length immediately inward of the channel 16. The wire track 46 terminates with an exit aperture 96 through which the wire 28 enters the cutter assembly 74. Sliding of the exit port assembly 74 is limited so that the exit aperture 96 remains adjacent to a portion of the cutting region 94 of the cutter 80. Consequently, the wire exiting the exit aperture 96 may pass through the cutting region and through the cutter block 76. The cutting region 94 occupies a sufficient length of the cutter 80 so that the exit port assembly 74 may be shifted from the starting position (shown in solid lines with three strands of wire 28 passing therethrough) to the inward position (shown in dashed lines with three strands of wire **28*b*). The exit port assembly 74 shifts to the inward position after the free ends of the wire have entered the channel 16** and begun to circulate. The inward positioning allows feeding to continue even after substantial numbers of loops of wire have been formed in the channel.

After feeding has stopped, and the continued circulation of the coil of wire pulls the innermost loop tightly against the core 20 (shown in FIG. 1), the wire **28*b* will be pulled into the position of wire 28*a* (shown in dashed lines in FIG. 5). Actuation of the cutter 80 and sliding of the exit port assembly 74 are provided by solenoids 100 and 102 respectively, with actuator bars 104 and 106** connected to transmit the actions of each solenoid.

Figure 6:
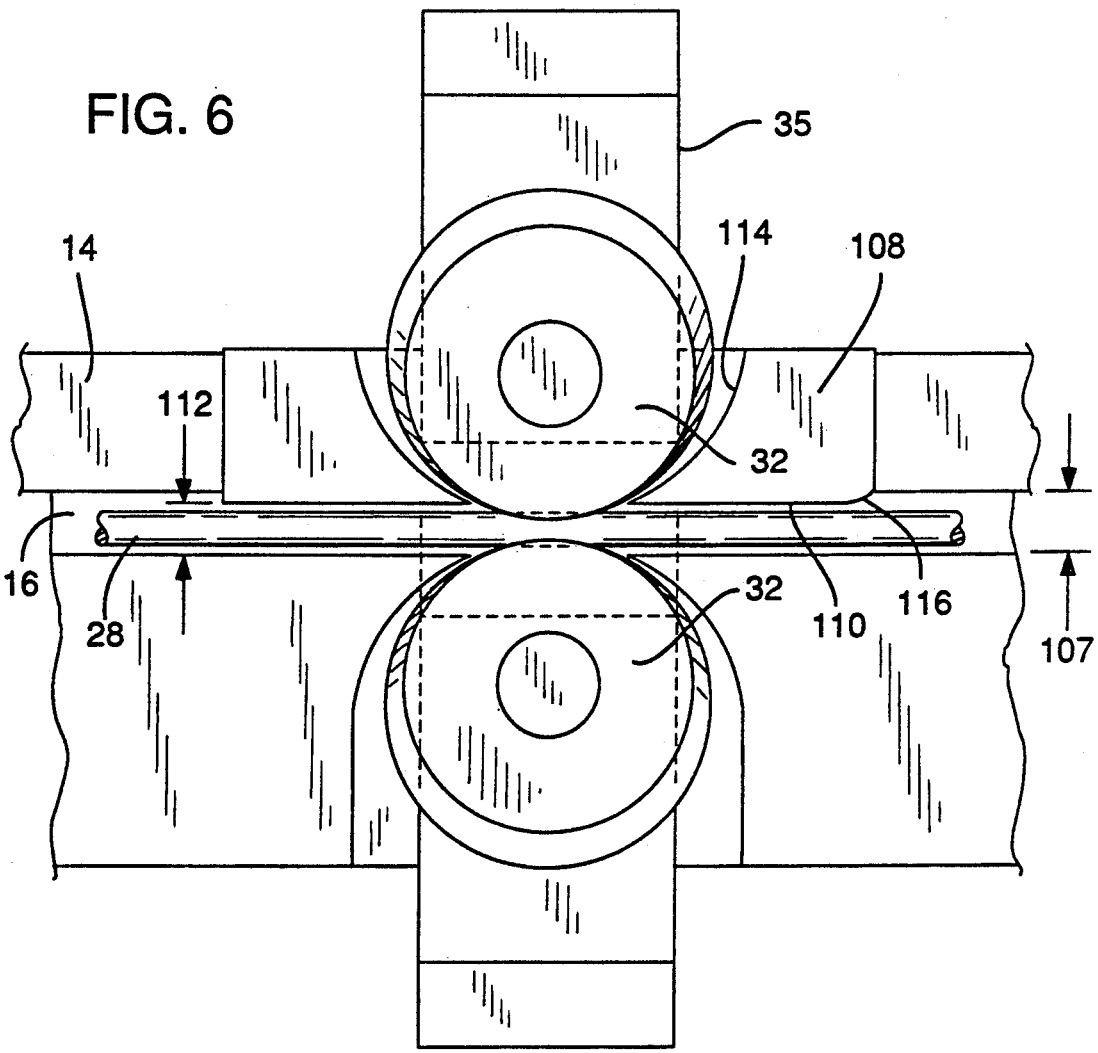
FIG. 6 is an enlarged sectional side view of a feed roller pair of the apparatus of FIG. 1 taken along line 6—6 of FIG. 1.

FIG. 6 shows the channel 16 as viewed from the center of the circulating chamber, in the plane of the channel, and facing the second circulating roller pair 32. A view of the first circulating roller pair 30 would appear similar. The channel 16 has a channel width 107 between 1.3 and 1.6 times the diameter of the wire 28 being circulated, with 1.45 times being preferable. This prevents adjacent wire coils from riding over one another as the wire circulates. It is also sufficiently wide to permit the wire 28 to circulate through the channel 16 without excessive friction normally caused by the unavoidable waviness of the wire 28. Adjacent the circulating roller pair 32, the channel assembly 14 includes a shoe 108, which has a flat lower surface 110 that creates a narrowed channel width 112. The shoe 108 defines an arcuate cutout 114 sized to closely receive the upper circulating roller to reduce any gaps between the shoe and the roller to prevent the wire from improperly jamming or escaping the channel 16. The narrowed width 112 is preferably less than the original channel width 107 by about ⅓ wire diameter.

The shoe 108 has a chamfered or rounded nose 116 at the leading corner of its lower surface 110 so that the leading end of an approaching wire is smoothly guided into the narrowed portion of the channel as the wire approaches the circulating rollers 32. The narrowed channel portion provided by the shoe 108 maintains the wire 28 in a flat coil even as the wire is subject to the greater stresses of tension and pressure created by the circulating rollers 32. This avoids the jamming that tends to occur near the rollers, while maintaining a low friction circulation. A similar structure is provided adjacent to circulating rollers 30.

The foregoing modifications and improvements may be employed separately or in combination to provide the stated benefits of improved process reliability, increased wire capacity, and process speed, among others.

Having illustrated and described the principles of my invention with reference to a preferred embodiment, it should be apparent to those skilled in the art that the embodiment may be modified without departing from such principles.

I claim:

1. An improved apparatus for winding a length of wire onto a toroidal core, the apparatus including:

channel means defining a generally circular radially inwardly open channel defining a core gap for accommodating the core so that wire residing in the channel passes through the core;

wire circulating means for circulating a coil of wire within the channel and through the core; and wire supply means for introducing wire into the channel at a feed rate and for cutting the wire, wherein the improvement comprises the combination of:

a) the wire circulating means having a first pair of circulating rollers and a second pair of circulating rollers, each circulating roller being driven at a circulation rate;

b) the first pair of circulating rollers being operable to retain a wire received therebetween with a first wire gripping force, the second pair of circulating rollers being operable to retain a wire received therebetween with a second wire gripping force less than the first wire gripping force;

c) the channel having narrowed portions adjacent the circulating roller pairs;

d) drive means operably connected to the wire supply means and the wire circulating means, the drive means for varying the ratio between the feed rate and the circulation rate;

e) the wire supply means further comprising a feed roller pair and a wire puller that draws wire from a source of wire at a first tension and introduces the wire to the feed roller pair at a second reduced wire tension;

f) the wire supply means comprising an exit port adjacent to the channel, the exit port being movable relative to the channel; and g) the wire supply means further comprising an adjustable cutter to compensate for cutter wear.

2. An apparatus for winding a length of wire onto a toroidal core comprising:

channel means defining a generally circular radially inwardly open channel defining a core gap for accommodating the core so that wire residing in the channel passes through the core;

feed rollers for rotating at a feed rate to advance wire into the channel;

circulating rollers for rotating at a circulation rate to circulate a coil of wire within the channel and through the core; and drive means for rotating the feed rollers at a feed rate and simultaneously rotating the circulating rollers at a circulation rate, and for varying the ratio between the feed rate and circulation rate as the wire is advanced into the channel.

3. The apparatus of claim 2 wherein the drive means reduces the ratio of the feed rate to the circulation rate as the wire is fed into the channel.

4. The apparatus of claim 2 wherein the drive means is infinitely variable.

5. The apparatus of claim 2 wherein the drive means includes a drive belt operably connected to the feed rollers.

6. A core winding apparatus for winding a length of wire onto a toroidal core comprising:

channel means defining a generally circular radially inwardly open channel defining a core gap for accommodating the core so that wire residing in the channel passes through the core;

a first pair of adjacent circulating rollers and a second pair of adjacent circulating rollers adjacent to the channel for circulating a coil of wire within the channel and through the core, the first pair of circulating rollers being configured to directly pinch the wire therebetween with a first wire gripping force, the second pair of circulating rollers being configured to directly pinch a wire therebetween with a second wire gripping force greater than the first wire gripping force, such that the wire may slip between the first pair of circulating rollers to accommodate rotation irregularities; and drive means for rotating at least one of the circulating rollers.

7. The apparatus of claim 6 wherein the first pair of circulating rollers are spaced apart by a gap.

8. The apparatus of claim 6 wherein the second pair of circulating rollers are in compressive contact.

9. The apparatus of claim 6 including a drive system for synchronously driving the circulating rollers.

10. The apparatus of claim 9 wherein the drive system includes a linkage operably connected to each circulating roller.

11. The apparatus of claim 10 wherein the drive system comprises a single motor.

12. A winding apparatus for winding a length of wire onto a toroidal core, the apparatus comprising:

channel means defining a generally circular radially inwardly open channel defining a core gap for accommodating the core so that wire residing in the channel passes through the core, the channel means including circulating means for passing the wire through the core to wind the wire onto the core; and wire supply means for introducing wire into the channel and for cutting the wire, the wire supply means having an exit port adjacent to the channel and moveable relative thereto.

13. The apparatus of claim 12 wherein the wire supply means includes a flexible conduit.

14. The apparatus of claim 13 wherein the conduit defines a plurality of wire passages.

15. The apparatus of claim 12 wherein the exit port is movable radially relative to the channel.

16. The apparatus of claim 12 wherein the wire supply means includes a wire cutter block defining a cylindrical bore with a close fitting cylindrical cutter rotatably received therein, the cutter block being split to define a closable gap, such that the gap may be narrowed to compensate for wear and to maintain a close fit between the cutter and the block.

17. A winding apparatus for winding a length of wire onto a toroidal core, the apparatus comprising:

channel means defining a generally circular radially inwardly open channel defining a core gap for accommodating the core so that wire residing in the channel passes through the core, the channel means including circulating means for passing the wire through the core to wind the wire onto the core; and wire supply means for introducing wire into the channel, the wire supply means including a cylindrical capstan for drawing wire from an original wire supply and introducing the wire to the feed roller pair, and for maintaining the wire at a first tension between the original wire supply and the capstan, and at a lesser second tension between the capstan and the feed roller pair.

18. A winding apparatus for winding a length of wire onto a toroidal core, the apparatus comprising:

channel means defining a generally circular radially inwardly open channel defining a core gap for accommodating the core so that wire residing in the channel passes through the core; and wire supply means for introducing wire into the channel, the wire supply means including a cylindrical capstan for drawing wire from an original wire supply and introducing the wire to the feed roller pair at a reduced wire tension.

wherein the wire supply means further comprises wire forming means between the original wire supply and the capstan for tensioning a portion of the wire between the wire straightening means and the capstan, such that the wire is imparted with a preselected curvature.

19. The apparatus of claim 18 wherein the preselected curvature has a radius greater than the radius of the circular channel.

20. A core winder for winding a length of wire onto a toroidal core, comprising:

channel means defining a generally circular radially inwardly open channel defining a core gap for accommodating the core so that wire residing in the channel passes through the core; and circulating rollers for circulating a coil of wire within the channel and through the core, the channel having narrowed portions adjacent to the circulating roller pairs.

21. The apparatus of claim 20 wherein the channel generally has a width of less than 1.5 times the wire diameter.

22. The apparatus of claim 20 wherein the narrowed portions of the channel have a width of less than 1.25 times the wire diameter.

23. A method of winding wire having a free end onto a toroidal core aligned with a generally circular radially inward open channel having a peripheral boundary defined by channel means, the method comprising the steps:

positioning a source of wire at a first position adjacent to the channel such that the wire may be smoothly received in the channel;

initiating feeding of the wire into the channel; and shifting the position of the source of wire to a second position such that the wire being fed into the channel does not interfere with the wire already in the channel.

24. The method of claim 23 wherein the first position is generally adjacent the peripheral boundary.

25. The method of claim 23 wherein the second position is located radially inward of the first position.

26. The method of claim 23 including the step of circulating the wire within the channel.

27. The method of claim 26 wherein the shifting step occurs before the free end has circulated entirely around the channel, such that the wire being fed is in the second position when the free end passes adjacent to the source of wire.

28. The method of claim 23 including the step of maintaining the source of wire in the second position while feeding continues.

29. A method of winding wire onto a toroidal core aligned with a generally circular radially inward open channel defined by channel means, the method comprising the steps:

feeding the wire into the channel at a feed rate;

circulating the wire within the channel at a circulation rate; and adjusting the feed rate as the wire is fed such that differences between the feed rate and the circulation rate are accommodated.

30. The method of claim 29 wherein the step of adjusting the feed rate includes reducing the feed rate as wire is fed into the channel.

31. The method of claim 29 wherein the feed rate is adjusted progressively during wire feeding.

* * * * *

UNITED STATES PATENT AND TRADEMARK OFFICE

CERTIFICATE OF CORRECTION

PATENT NO. : 5,282,580

DATED : February 1, 1994

INVENTOR(S) : Bryan Kent

It is certified that error appears in the above-indentified patent and that said Letters Patent is hereby corrected as shown below:

Column 7, line 23, after "principles.", insert --I claim as my invention all such modifications as come within the true spirit and scope of the following claims.--

Signed and Sealed this

Twentieth Day of February, 1996

*Attest:*

Bruce Lehman

BRUCE LEHMAN

*Attesting Officer*

*Commissioner of Patents and Trademarks*